US008590714B1

(12) United States Patent
Osuna-Valerio

(10) Patent No.: US 8,590,714 B1
(45) Date of Patent: Nov. 26, 2013

(54) CASH BOX HOLDING APPARATUS

(76) Inventor: Jose L. Osuna-Valerio, Tucson, AZ (US)

( * ) Notice: Subject to any disclaimer, the term of this patent is extended or adjusted under 35 U.S.C. 154(b) by 0 days.

(21) Appl. No.: 13/475,293

(22) Filed: May 18, 2012

(51) Int. Cl.

| | |
|---|---|
| ***E05B 73/00*** | (2006.01) |
| *A47F 5/08* | (2006.01) |
| *A47F 5/00* | (2006.01) |
| *E05B 69/00* | (2006.01) |
| *E05G 1/00* | (2006.01) |
| *E05G 1/04* | (2006.01) |
| *E05B 65/48* | (2006.01) |
| *E05B 55/14* | (2006.01) |

(52) U.S. Cl.
USPC ..... 211/4; 211/113; 70/18; 70/58; 70/63; 70/164; 109/50; 109/51; 248/309.1

(58) Field of Classification Search
USPC ..... 211/4, 8, 206, 191, 192, 13.1, 26.2, 211/86.01, 85.29, 71.01; 70/18, 58, 63, 70/164; 232/1 D, 15, 16; 248/200, 309.1; 312/223.3; 108/50.02; 109/50–52
See application file for complete search history.

(56) References Cited

U.S. PATENT DOCUMENTS

| | | | | | |
|---|---|---|---|---|---|
| 711,326 | A | * | 10/1902 | Lowrie | 109/50 |
| 1,166,062 | A | * | 12/1915 | Lewis | 312/351.8 |
| 1,695,517 | A | * | 12/1928 | Waldbauer | 211/124 |
| 1,857,522 | A | * | 5/1932 | Ungeheuer | 220/8 |
| 3,292,849 | A | * | 12/1966 | Ewing | 232/43.2 |
| 3,353,743 | A | * | 11/1967 | Amundsen | 232/15 |
| 3,433,185 | A | * | 3/1969 | Roberts | 109/55 |
| 3,570,676 | A | * | 3/1971 | Crosslen | 211/4 |
| 3,784,269 | A | * | 1/1974 | Frenkel | 312/136 |
| 3,797,735 | A | * | 3/1974 | Sciortino et al. | 232/16 |
| 3,945,227 | A | * | 3/1976 | Reiland | 70/58 |
| 4,028,913 | A | * | 6/1977 | Falk | 70/58 |
| 4,113,107 | A | * | 9/1978 | Jaeger | 211/4 |
| 4,186,977 | A | * | 2/1980 | Gilovich et al. | 312/215 |
| 4,452,390 | A | * | 6/1984 | West | 232/4 R |
| 4,696,449 | A | * | 9/1987 | Woo et al. | 248/553 |
| 4,700,849 | A | * | 10/1987 | Wagner | 211/41.2 |
| 4,751,885 | A | * | 6/1988 | Squire | 109/51 |
| 4,790,476 | A | * | 12/1988 | Tanaka et al. | 232/1 D |
| 5,020,450 | A | * | 6/1991 | Lichter | 109/50 |
| 5,064,161 | A | * | 11/1991 | Anderson | 248/317 |
| 5,085,395 | A | * | 2/1992 | Frater et al. | 248/552 |
| 5,097,968 | A | * | 3/1992 | Gregory | 211/94.01 |
| 5,595,074 | A | * | 1/1997 | Munro | 70/58 |
| 5,607,102 | A | * | 3/1997 | Walsh et al. | 232/1 D |
| 5,690,403 | A | * | 11/1997 | Ellison et al. | 312/223.6 |
| 5,738,324 | A | * | 4/1998 | Van Hout et al. | 248/317 |
| 5,743,438 | A | * | 4/1998 | Sokolnicki | 222/181.1 |
| 5,769,006 | A | * | 6/1998 | Allaer | 109/73 |
| 5,816,076 | A | * | 10/1998 | Biedermann et al. | 70/57 |
| 5,890,439 | A | * | 4/1999 | McGunn | 109/47 |
| 5,971,166 | A | * | 10/1999 | Ong | 211/46 |
| 6,029,580 | A | * | 2/2000 | Alfonso et al. | 108/26 |
| 6,068,228 | A | * | 5/2000 | Kobayashi et al. | 248/309.1 |
| 6,082,838 | A | * | 7/2000 | Bissu-Palombo | 312/195 |
| 6,098,944 | A | * | 8/2000 | Pangborn et al. | 248/317 |
| 6,330,816 | B1 | * | 12/2001 | O'Connor | 70/63 |
| 6,340,145 | B1 | * | 1/2002 | Tagami et al. | 248/317 |

(Continued)

*Primary Examiner* — Joshua J Michener
*Assistant Examiner* — Devin Barnett

(57) ABSTRACT

A cash box holding apparatus for use in holding cash boxes under gaming tables and the like. The apparatus provides a basic lightweight structure which offers double retention means for a cash box. The apparatus features ease of use and time saving insertion and removal of cash boxes.

1 Claim, 5 Drawing Sheets

(56) References Cited

U.S. PATENT DOCUMENTS

| | | | | |
|---|---|---|---|---|
| 6,397,644 | B1 * | 6/2002 | Gidding | 70/18 |
| 6,431,203 | B1 * | 8/2002 | Zhu et al. | 137/315.01 |
| 6,490,893 | B1 * | 12/2002 | Benion | 70/63 |
| D470,353 | S * | 2/2003 | Mikich et al. | D6/513 |
| 6,640,978 | B2 * | 11/2003 | Reiser et al. | 211/4 |
| 6,817,684 | B2 * | 11/2004 | Cattaneo | 312/223.6 |
| 6,824,230 | B2 * | 11/2004 | Probst | 312/223.3 |
| 7,185,865 | B1 * | 3/2007 | Patrick | 248/318 |
| 7,954,783 | B2 * | 6/2011 | Vigil | 248/553 |
| 8,020,416 | B2 * | 9/2011 | Talmage et al. | 70/85 |
| 8,066,131 | B2 * | 11/2011 | Mansor et al. | 211/117 |
| 2002/0060194 | A1 * | 5/2002 | Reiser et al. | 211/4 |
| 2002/0158175 | A1 * | 10/2002 | Hsieh | 248/309.1 |
| 2004/0149178 | A1 * | 8/2004 | Schaefers et al. | 108/50.02 |
| 2009/0127216 | A1 * | 5/2009 | Young | 211/113 |
| 2009/0255889 | A1 * | 10/2009 | Geffe | 211/113 |
| 2010/0043682 | A1 * | 2/2010 | Talmage et al. | 109/50 |
| 2010/0052486 | A1 * | 3/2010 | Hemmer | 312/223.3 |
| 2010/0066148 | A1 * | 3/2010 | Matthews | 297/423.12 |
| 2010/0122664 | A1 * | 5/2010 | Weatherbee, Jr. | 119/705 |
| 2010/0327714 | A1 * | 12/2010 | Haberman | 312/223.3 |
| 2011/0155871 | A1 * | 6/2011 | Li et al. | 248/201 |
| 2011/0186706 | A1 * | 8/2011 | Xue | 248/304 |
| 2012/0175331 | A1 * | 7/2012 | Yu | 211/119 |
| 2013/0081559 | A1 * | 4/2013 | Roh | 108/50.02 |
| 2013/0133558 | A1 * | 5/2013 | Andrews | 109/50 |

* cited by examiner

CASH BOX HOLDING APPARATUS

BACKGROUND OF THE INVENTION

Cash boxes are prevalent in the commercial world. Cash boxes store currency and coin until removed for transfer, in many gaming establishments, as example. The mechanisms for holding cash boxes prior to removal from a gaming table are varied and can be problematic. Security of the cash box is a foremost concern. Ease of installation and removal of the cash box is also a primary consideration, as any downtime for a table represents lost revenue. What is needed is a new apparatus for holding gaming table cash boxes, one which utilizes existing cash boxes in providing security, smooth and fast box transfer, and decreased surveillance efforts. The apparatus should be without complexity and consequently without the potential for box to jamb or stick upon insertion or removal. The apparatus should be lightweight and strong.

FIELD OF THE INVENTION

The cash box holding apparatus relates to cash and valuable storage boxes and more specifically to a cash box holding apparatus which provides ease of use and two forms of retaining a cash box.

DESCRIPTION OF THE PRIOR ART

Prior related art U.S. Pat. No. 4,186,977 issued to Gilovich et al., Feb. 5, 1980 teaches a self-locking depository container for cash and documents. The device addresses issues unlike those of the present apparatus. For example, the device focuses on insuring that the depository must be relocked prior to removal from the housing. The present apparatus solves other problems as listed in the background—securely holding a cash box, and the quick removal and installation of same. The locking of the box itself is not a design concern of the present apparatus. U.S. Pat. No. 4,790,476 issued to Tanaka et al., Dec. 13, 1988 teaches a money-collecting box having at its top a slot across which a bill is transferred. The box is like those which might be used in the present apparatus. U.S. Pat. No. 5,890,439 issued to McGunn, Apr. 6, 1999 teaches an improved safe deposit box assembly including an inner box and outer housing, and one or more lock devices. The device teaches and claims a depository box with a sliding cover. The device does not include a housing similar to that of the present apparatus.

While the above-described devices fulfill their respective and particular objects and requirements, they do not describe a cash box holding apparatus that provides for the advantages of the cash box holding apparatus. In this respect, the cash box holding apparatus substantially departs from the conventional concepts and designs of the prior art. Therefore, a need exists for an improved cash box holding apparatus.

SUMMARY OF THE INVENTION

The general purpose of the cash box holding apparatus, described subsequently in greater detail, is to provide a cash box holding apparatus which has many novel features that result in an improved cash box holding apparatus which is not anticipated, rendered obvious, suggested, or even implied by prior art, either alone or in combination thereof.

To attain this, the cash box holding apparatus is comprised of side frames attached to a bottom. Both side frames and bottom are comprised of cutouts in order to save weight. The side frames are fitted with mount flanges so that the apparatus can be fixed to the bottom of a gaming table. The apparatus is located such that the table slot is aligned with the cash box slot when the cash box is within the apparatus. The basic nature and smooth interior surfaces of the apparatus provide for easy insertion and removal of the cash box. The latch provided with the apparatus is to be affixed to the cash box such that the latch removably secures the cash box to the rear fence of the apparatus. The cash box is further retained within the apparatus by the gate. The gate swings across the front of the apparatus and is locked via a typical lock.

Thus has been broadly outlined the more important features of the improved cash box holding apparatus so that the detailed description thereof that follows may be better understood and in order that the present contribution to the art may be better appreciated.

An object of the cash box holding apparatus is to be lightweight.

Another object of the cash box holding apparatus is to save time in use.

A further object of the cash box holding apparatus is to provide for two forms of retaining a cash box.

These together with additional objects, features and advantages of the improved cash box holding apparatus will be readily apparent to those of ordinary skill in the art upon reading the following detailed description of presently preferred, but nonetheless illustrative, embodiments of the improved cash box holding apparatus when taken in conjunction with the accompanying drawings.

In this respect, before explaining the current embodiments of the improved cash box holding apparatus in detail, it is to be understood that the cash box holding apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved cash box holding apparatus. It is therefore important that the claims be regarded as including such equivalent constructions insofar as they do not depart from the spirit and scope of the cash box holding apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 7 thereof, the principles and concepts of the cash box holding apparatus generally designated by the reference number 10 will be described.

Figures 1, 2:
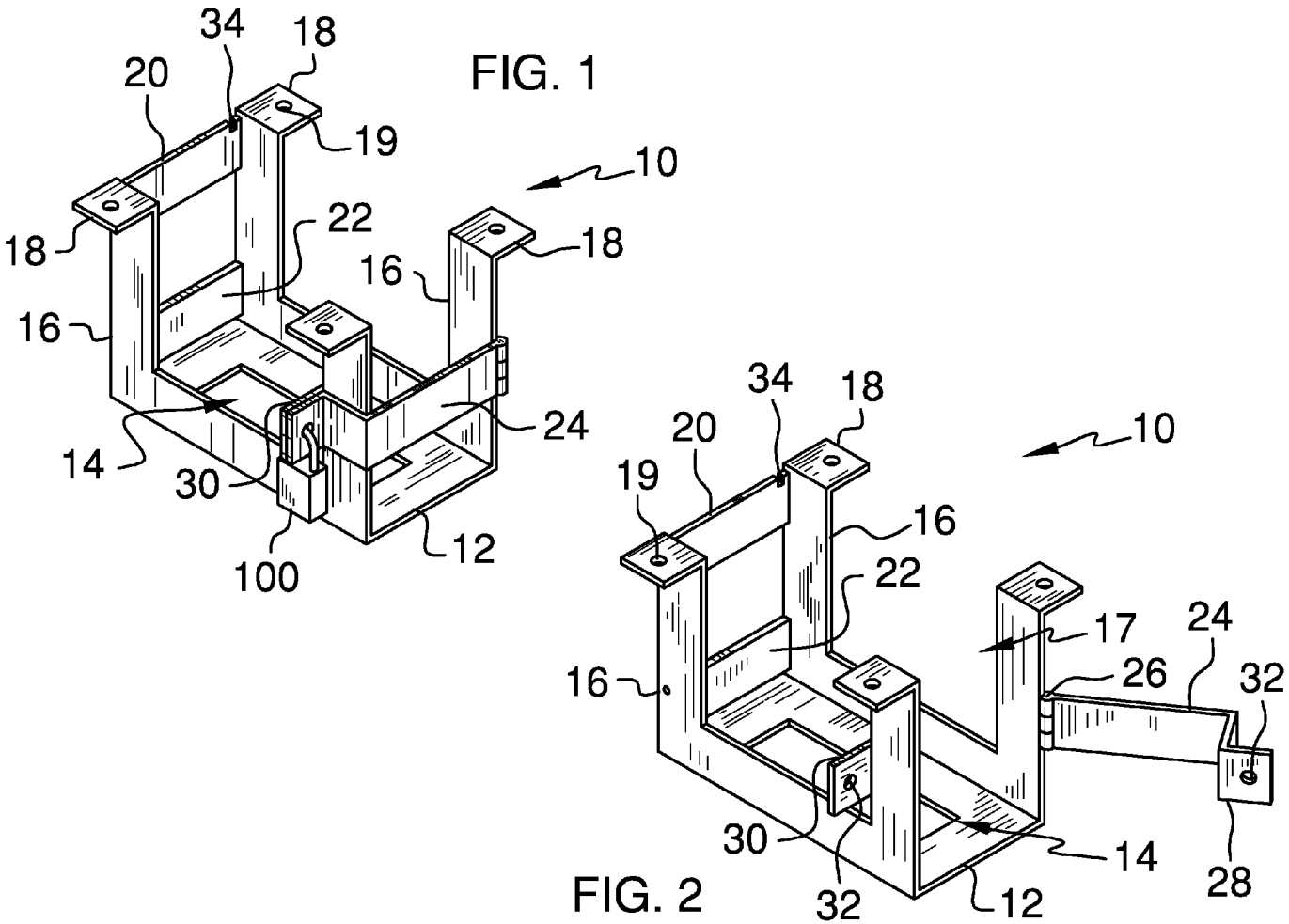
FIG. 1 is a perspective view of the locked apparatus.
FIG. 2 is a perspective view of the apparatus with gate opened.
Figure 3:
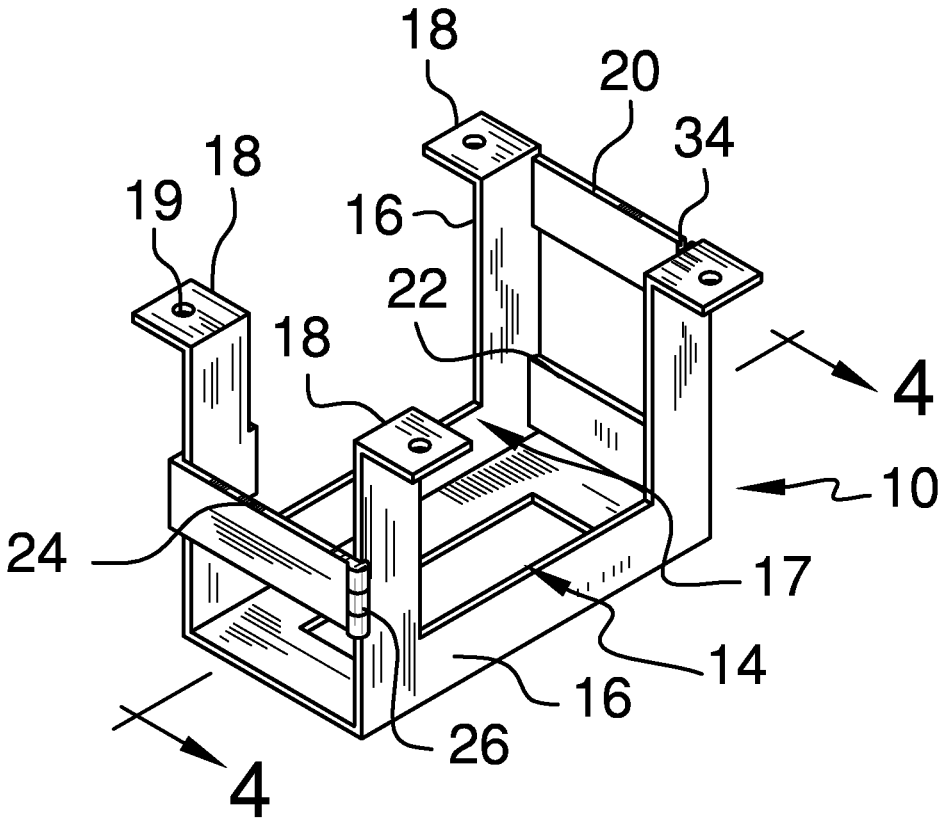
FIG. 3 is a perspective view of the gate closed.

Referring to FIGS. 1, 2, and 3, the cash box holding apparatus 10 comprises a five-sided apparatus 10 with an open top. The apparatus 10 further comprises a rectangular bottom 12.

The bottom 12 has two spaced apart sides and two spaced apart ends. The cutout 14 of the bottom 12 is provided to lighten the apparatus 10. A full bottom 12 without a cutout 14 is not needed. The apparatus 10 further comprises the vertical first side frame 16 and the vertical second side frame 16. Each side frame 16 has a top and a bottom. Each side frame 16 has a back and a front. Each side frame is further comprised of a frame cutout 17. The frame cutout 17 lightens the apparatus 10. A solid side frame 16 is not needed. Each side frame 16 is attached perpendicularly to an outside of each side of the bottom 12. A mount flange 18 is attached to a top of an each end of each side frame 16. Each flange 18 is attached at a right angle to a height of the side frames 16. A mount hole 19 is disposed in each flange 18. A lock ear 30 is affixed to the second side frame 16. The ear 30 is perpendicular to the vertical plane of the side frame 16. The ear is projected outwardly from the frame 16. A lock orifice 32 is disposed in the ear 30. The upper rear fence 20 connects the back of the first side frame 16 to the back of the second side frame 16. The upper fence 20 is proximal to the top of each side frame 16. The lower rear fence 22 connects the back of the first side frame 16 to the back of the second side frame 16. The lower fence 22 is proximal to the bottom of each side frame 16. The latch slot 34 is disposed in an upper edge of the upper fence 20. The latch slot 34 is proximal to the first side frame 16. A hinge 26 is attached to the front of the first side frame 16. The gate 24 is affixed to the hinge 26. The gate 24 is pivoted to reach the second side frame 16. The right angle 28 is a part of the end of the gate 24 opposite the hinge 26. The hinge 26 is pivoted so that the right angle 28 meets the second side frame 16 front and the lock ear 30. A lock orifice 32 is disposed in the right angle 28. The lock orifice 32 of the right angle 28 aligns with the lock orifice 32 of the lock ear 30.

Figure 5:
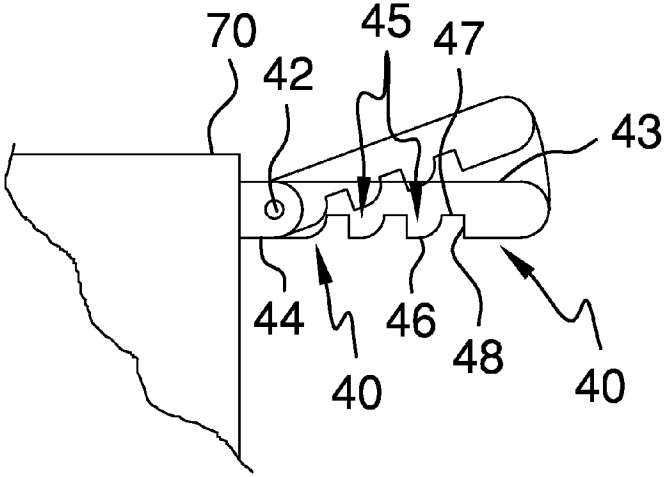
FIG. 5 is a side elevation view of the latch of FIG. 4, taken along the line 5-5.
Figure 4:
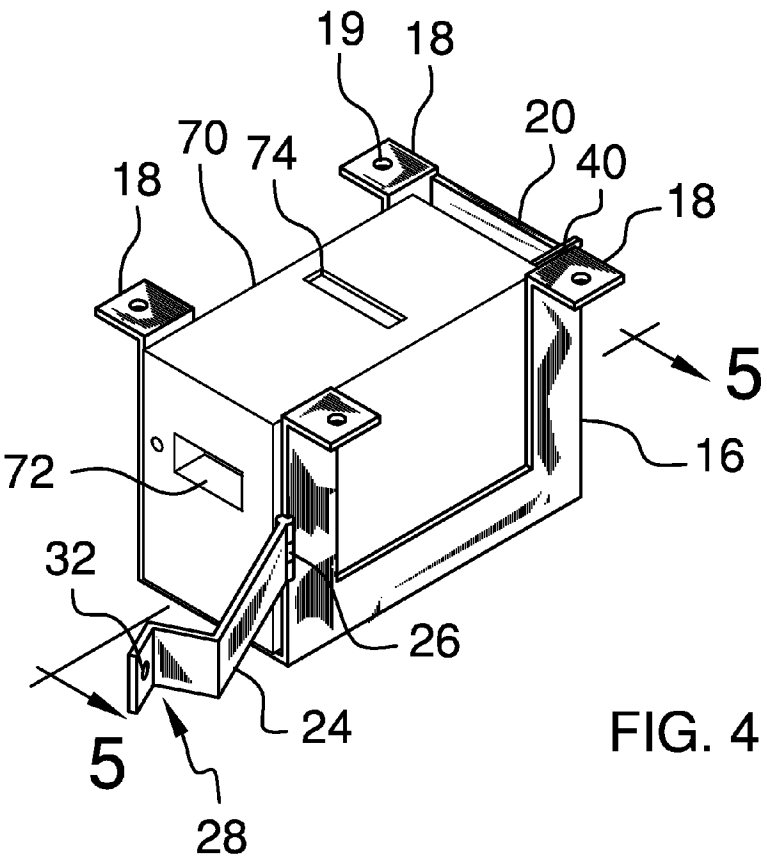
FIG. 4 is a perspective view with a cash box fitted, the view taken from FIG. 3 along the line 4-4.

Referring to FIGS. 4 and 5, the gate 24 of the apparatus 10 is pivoted open. The cash box 70 is slideably fitted into the apparatus 10. The cash box 70 is not a part of the apparatus 10. The pull 72 of the cash box 70 is positioned toward the gate 24 of the apparatus 10. The latch 40 is provided as a part of the apparatus 10. The latch 40 is to be fitted to the upper rear of the cash box 70. The latch 40 comprises a latch flange 44 to be affixed to the cash box 70. The latch 40 is further comprised of a pivot 42 on the latch flange 44. The latch arm 43 is pivotally affixed to the pivot 42. A plurality of teeth 45 are disposed along the bottom of the latch arm 43. Each tooth 45 partially comprises a rounded edge 46. The rounded edge 46 is followed, outwardly, by a gap 47. A catch edge 48 outwardly follows each gap 47. A gap 47 connects each rounded edges 46 to each catch edge 48. The latch 40 is pivoted upwardly as the box 70 is slid into the apparatus 10. The rounded edges 46 enable the latch 40 to slide over the latch slot 34 of the upper rear fence 20. The box 70 is removed by lifting the latch arm 43, thereby releasing the catch edges 48 from the slot 34 as the box 70 is slid out from the apparatus 10. The gate 24 is pivoted to contain the box 70. The lock orifices 32 of the gate 24 and the lock ear 30 are used to affix a lock 100 for retaining the gate 24.

Figure 6:
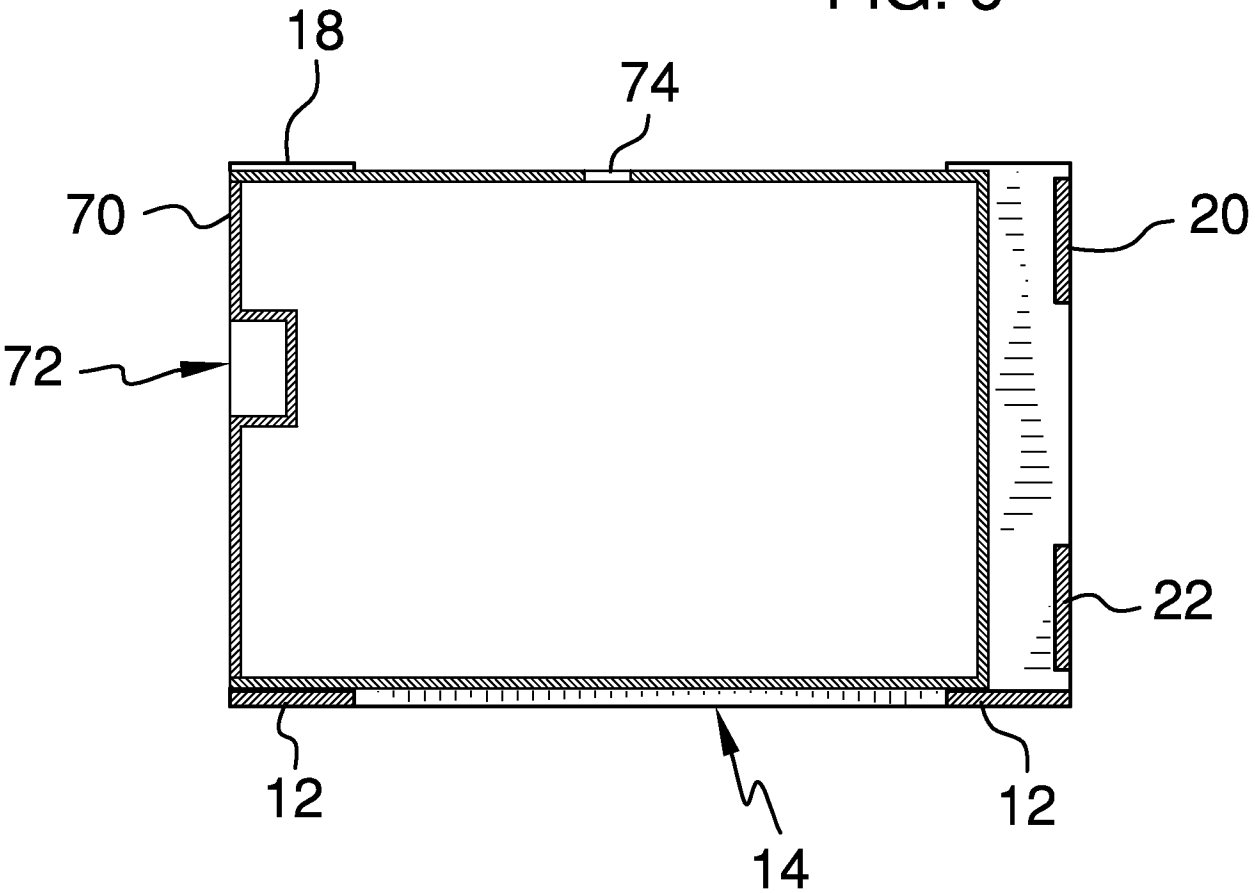
FIG. 6 is a side cross sectional view of FIG. 4.
Figure 7:
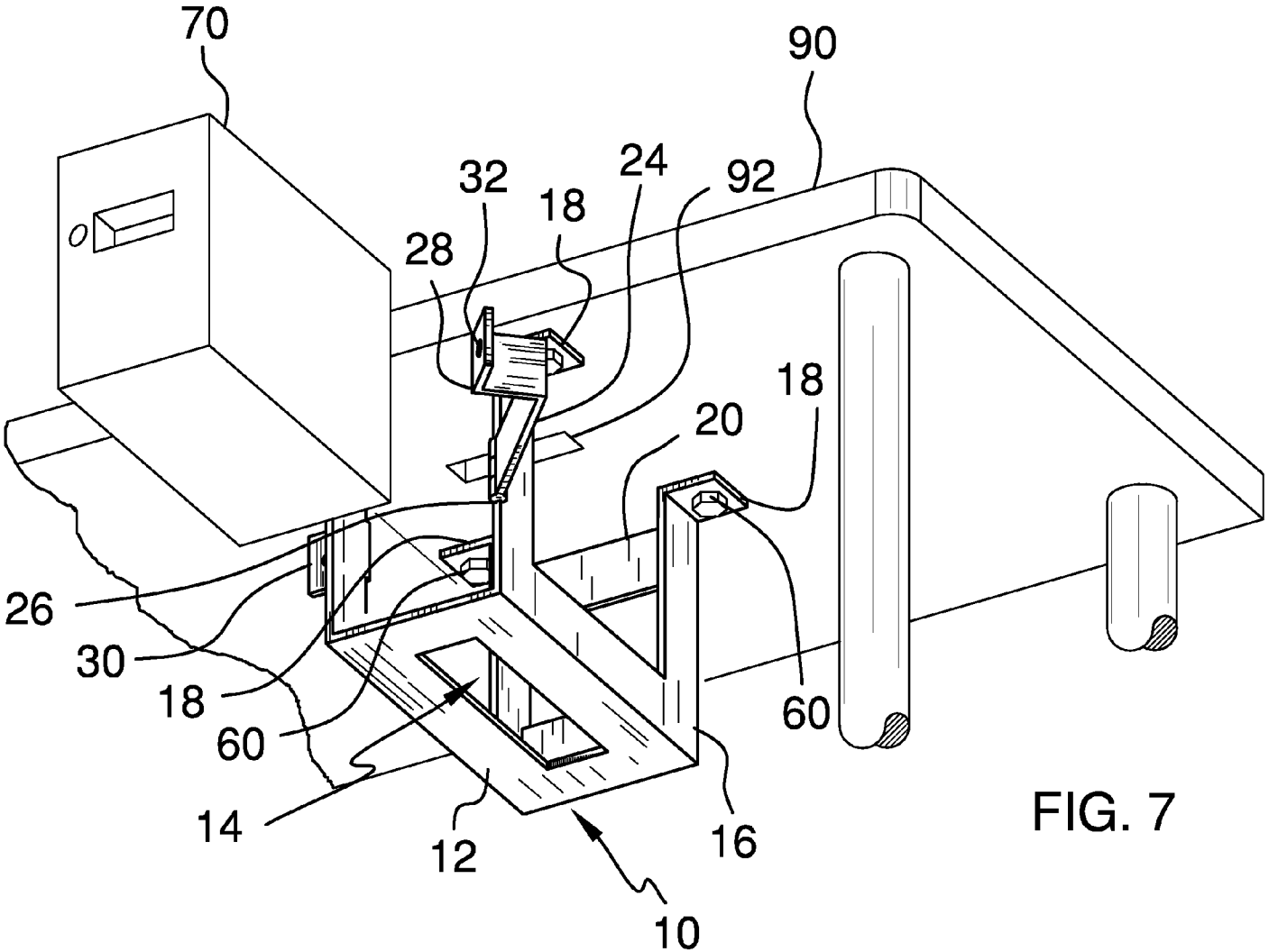
FIG. 7 is a perspective view of the apparatus fitted to a gaming table.

Referring to FIGS. 6 and 7, the apparatus 10 is affixed to the bottom of a gaming table 90 via the fasteners 60 though the mount holes 19 and into the table 90. The apparatus 10 is affixed to the table 90 such that the table slot 92 aligns with the cash box slot 74 when the box 70 is fitted within the apparatus 10.

In use, the cash box 70 is slid into the apparatus 10. The latch 40 is manually elevated to slide over the latch slot 34. With the box 70 fitted within the apparatus 10, a catch edge 48 of the latch secures the box 70 to the upper rear fence 20. The gate 24 is closed and locked with a lock 100 or the like. Cash and other values atop the gaming table 90 a fitted through the table slot 92 and through the box slot 74. The box 70 is removed by removing the lock 100 and opening the gate 24. The latch arm 43 is lifted to allow the box 70 to be slid out of the apparatus 10.

With respect to the above description then, it is to be realized that the optimum dimensional relationships for the parts of the cash box holding apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the cash box holding apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the cash box holding apparatus may be used.

Therefore, the foregoing is considered as illustrative only of the principles of the cash box holding apparatus. Further, since numerous modifications and changes will readily occur to those skilled in the art, it is not desired to limit the cash box holding apparatus to the exact construction and operation shown and described, and accordingly, all suitable modifications and equivalents may be resorted to, falling within the scope of the cash box holding apparatus.

What is claimed is:

1. A cash box holding system, the system comprising, in combination:

a five-sided apparatus with an open top, the apparatus comprising:

a rectangular bottom, the bottom having two spaced apart sides and two spaced apart ends;

a vertical first side frame and a vertical second side frame, each side frame having a top and a bottom, each side frame having a back and a front, each side frame attached perpendicularly to an outside of each side of the bottom;

a mount flange attached to a top of an each end of each side frame, each flange attached at a right angle to a height of the side frames;

a mount hole in each flange for fastening the apparatus to a support;

a lock ear affixed to the second side frame, the ear perpendicular to the vertical plane of the side frame, the ear projected outwardly from the frame;

a lock orifice in the ear;

an upper rear fence, the upper fence connecting the back of the first side frame to the back of the second side frame, the upper fence proximal to the top of each side frame;

a lower rear fence, the lower fence connecting the back of the first side frame to the back of the second side frame, the lower fence proximal to the bottom of each side frame;

a latch slot in an upper edge of the upper fence;

a hinge attached to the front of the first side frame;

a gate affixed to the hinge, the gate pivoted to reach the second side frame;

a right angle member on an end of the gate, the gate pivoted to contact the second side frame front, the right angle member meeting the lock ear;

a lock orifice in the right angle;

a latch attached to an upper rear of the cash box, the latch comprising:

a latch flange affixed to the cash box;

a pivot on the latch flange;

a latch arm pivotally affixed to the pivot;

a plurality of teeth along a bottom of the latch arm, each tooth comprising:

a rounded edge;

a catch edge;

a gap between the rounded edge and the catch edge, whereby the box fits within the apparatus, the latch is removably hooked on the latch slot, the gate is pivoted to contain the box, the lock orifices of the gate and the lock ear are used to affix a lock for retaining the gate.

* * * * *